US010856701B2

(12) United States Patent
Elbari et al.

(10) Patent No.: US 10,856,701 B2
(45) Date of Patent: Dec. 8, 2020

(54) SHOWER TRAY

(71) Applicants: Valerio Elbari, San Pietro in Cariano (IT); Giampaolo Lugoboni, Marano di Valpolicella (IT)

(72) Inventors: Valerio Elbari, San Pietro in Cariano (IT); Giampaolo Lugoboni, Marano di Valpolicella (IT)

( * ) Notice: Subject to any disclaimer, the term of this patent is extended or adjusted under 35 U.S.C. 154(b) by 0 days.

(21) Appl. No.: 16/229,414

(22) Filed: Dec. 21, 2018

(65) Prior Publication Data

US 2019/0191933 A1 Jun. 27, 2019

(30) Foreign Application Priority Data

Dec. 22, 2017 (IT) ..... 102017000149250

(51) Int. Cl.
*A47K 3/40* (2006.01)

(52) U.S. Cl.
CPC ..... *A47K 3/40* (2013.01); *A47K 3/405* (2013.01)

(58) Field of Classification Search
CPC ..... A47K 3/28; A47K 3/40; A47K 3/405
USPC ..... 4/613
See application file for complete search history.

(56) References Cited

U.S. PATENT DOCUMENTS

2002/0066140 A1* 6/2002 Gerloff ..... A47K 3/16 4/613
2011/0231991 A1* 9/2011 Valdenaire ..... A47K 3/40 4/613
2013/0061387 A1* 3/2013 Stetson ..... E03F 5/0408 4/613
2016/0270604 A1* 9/2016 McLeod ..... E03C 1/22

FOREIGN PATENT DOCUMENTS

DE 10 2011 119697 A1 5/2013
DE 102011119697 A1 * 5/2013 ..... A47K 3/405
WO 2016/181207 A1 11/2016

OTHER PUBLICATIONS

IT Search Report, dated Sep. 3, 2018, from corresponding IT 102017000149250 application.

* cited by examiner

*Primary Examiner* — Huyen D Le
(74) *Attorney, Agent, or Firm* — Nixon & Vanderhye

(57) ABSTRACT

Disclosed is a shower tray with a walking surface placed at the top of a collecting tub. The walking surface is surrounded by a coplanar perimeter frame from which it is spaced, thereby forming a continuous perimeter slot allowing water to flow into the collecting tub. The shower tray includes an automatic system to easily and conveniently access the innermost parts of the shower tray, below the walking surface.

20 Claims, 2 Drawing Sheets

SHOWER TRAY

The present invention refers, in general, to a shower tray. More particularly, the present invention refers to a shower tray with an automatic system to easily and conveniently access the innermost parts of the shower tray.

BACKGROUND OF THE INVENTION

As it is known, the most modern shower trays with better aesthetic results usually include a walking surface that is placed above a collecting tub. The walking surface is slightly separated from a coplanar perimeter frame so that it is possible to obtain a continuous slot through which water can flow down where it is collected into the collecting tub that is conveniently provided with a drain.

In order to access the collecting tub for cleaning purposes, it is necessary to lift the walking surface and move it to an adjacent area.

However, the so-described operations are rather difficult and not very easy because first of all it is necessary to perform said operations in usually narrow spaces.

Besides, the lifting of the walking surface has to be carried out by taking the edge of the walking surface acting in the slot that is provided between the walking surface and the perimeter frame.

However, the dimensions of the slot are rather small, also to meet specific legal requirements.

In addition, it is necessary to keep in mind that the shower trays according to the type just described are often used in luxurious environments such as yachts or luxury homes.

In these cases, the walking surface can be made even of marble or other precious material. However, these materials are often heavy.

Consequently, the operations for the removal of the walking surface are even more complex and can cause damage both to the same walking surface, and to the structures around (walls, taps, etc.).

SUMMARY OF THE INVENTION

An object of the invention is to overcome the aforementioned drawbacks and others through a shower tray that offers an easy access to the innermost parts of the shower tray.

Another object of the invention is to provide a shower tray that can be easily cleaned.

A further object of the invention is to provide a shower tray with a walking surface that is easily removable.

The above mentioned objects and others are reached according to the invention through a shower tray comprising a collecting tub suitable to be fixed on a screed, and a walking surface placed at the top of the collecting tub. The walking surface is surrounded by a coplanar perimeter frame from which it is slightly spaced so as to form a continuous perimeter slot to allow water to flow into the collecting tub.

The shower tray according to the invention is characterized by the fact of comprising automatic lifting means to lift the walking surface with respect to the collecting tub.

Through the presence of said automatic lifting means, it is not necessary to intervene manually in order to remove the walking surface.

Hence, who has to clean, for example, the collecting tub, is not compelled to grasp the walking surface that, instead, is moved automatically.

Besides, one or more nozzles can be received in the collecting tub and are suitable for spraying water into which a detergent has been possibly added in order to wash and cleanse the collecting tub.

In this way, the washing of the collecting tub can be carried out automatically and comfortably.

Advantageously, the walking surface can be pivoted along a first side to a first support fixed to the collecting tub, so that the automatic lifting means incline the walking surface.

Thus, it is sufficient to incline the walking surface, hinged along one side of it, to allow free access to the collecting tub below it.

In addition, locking means may be comprised and are placed on the opposite side of the walking surface with respect to the first side, and can lock the walking surface horizontally and coplanar to the perimeter frame.

Advantageously, the locking means may include an eyelet fixed to the walking surface and a translating locking pin, arranged on the collecting tub and adapted to be inserted into the eyelet or removed from the eyelet so as to lock or free the eyelet and consequently the walking surface, respectively.

The user can easily lift the walking surface by acting on a switch, the locking pin being connected through a mechanical system to the switch.

Advantageously, the mechanical system may include a connection shaft to which the locking pin is screwed so as to translate the locking pin through its screwing.

In this way, in case of malfunction of the switch or the mechanical system connected to it, it is possible to unscrew or screw the locking pin with respect to the connection shaft so as to translate it and free the eyelet.

Besides, the automatic lifting means may include a gas spring with a movable stem; said gas spring is fixed to the collecting tub while the free end of the stem is fixed to the walking surface.

With this configuration, when the switch is pressed and the eyelet is let free, the walking surface tilts since the gas spring is free to extend.

Likewise, the automatic lifting means may include an actuator with movable stem, said actuator being fixed to the collecting tub, the free end of the stem being fixed to the walking surface.

In order to strengthen the structure and ensure an easy lifting mechanism, the walking surface may include a frame and a slab fixed at the top of the frame.

In order to obtain an excellent aesthetic result, the slab may be in stone material.

BRIEF DESCRIPTION OF THE DRAWINGS

Further features and details of the invention will be better understood from the following specification that is given by way of a non-restricting example as well as from the annexed drawing, wherein.

DETAILED DESCRIPTION OF THE PREFERRED EMBODIMENTS

Figure 1:
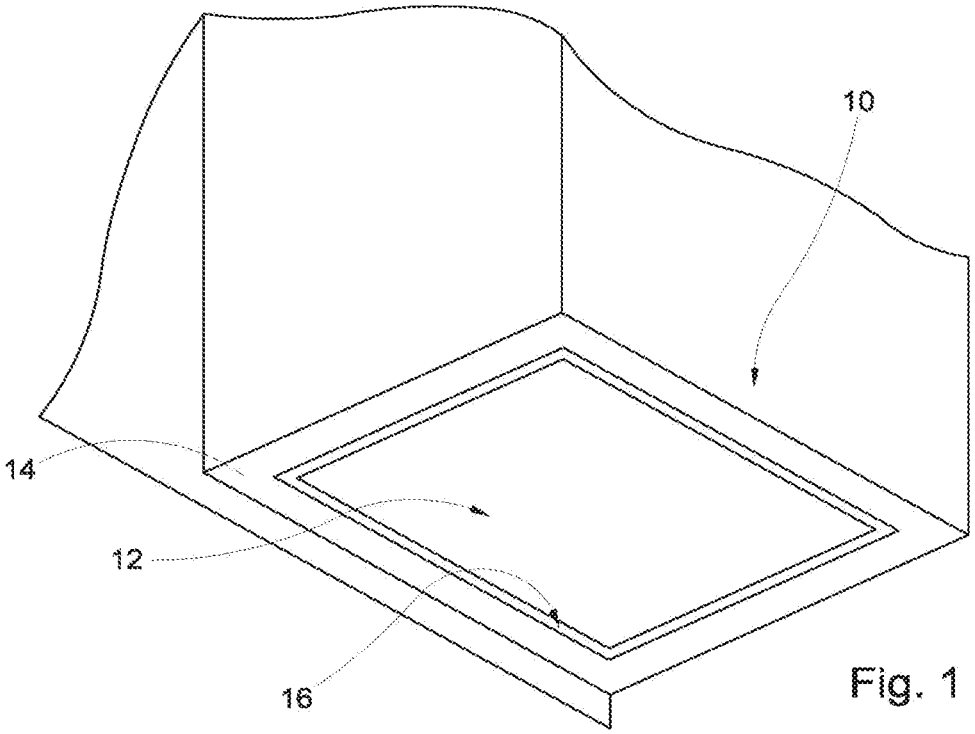
FIG. 1 is a schematic axonometric view of a shower tray according to the invention, comprising a walking surface arranged in a position allowing the use of the shower.
Figure 2:
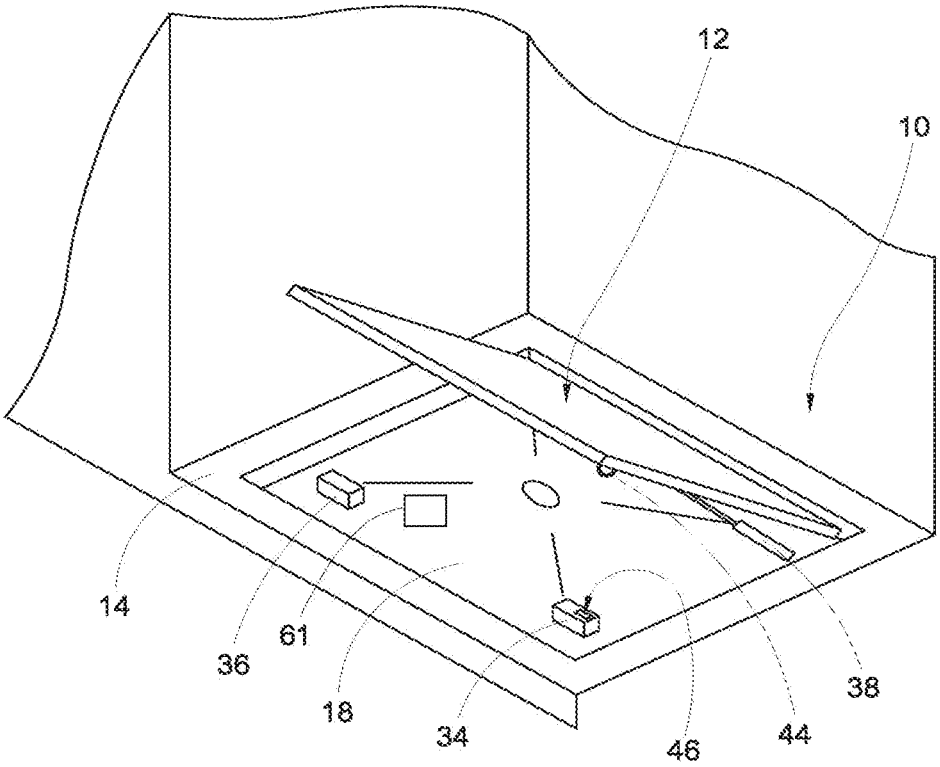
FIG. 2 is a schematic view of the shower tray in FIG. 1, in which the walking surface is lifted with respect to the water collecting tub which is placed below the walking surface.

With reference to the annexed drawing, reference number 10 denotes a shower tray comprising a walking surface 12 around which a perimeter frame 14 is arranged which is coplanar to the walking surface 12.

The walking surface 12 is slightly spaced from the perimeter frame 14 for a distance shorter than 50 millimeters so as to form a continuous perimeter slot 16 through which water can be discharged.

Below the walking surface 12 and the perimeter frame 14, a collecting tub 18 is placed which collects water passing through the perimeter slot 16.

The collecting tub 18 includes anchor brackets 20 which allow to fix the collecting tub 20 to a screed M or, in any case, to a lower support plane.

The collecting tub 18 has a bottom with slope so that water can flow to the central area where an exhaust pipe 22 is provided. A filtering means 24 such as a filter or a narrow mesh net is provided on an opening of the exhaust pipe.

Figure 3:
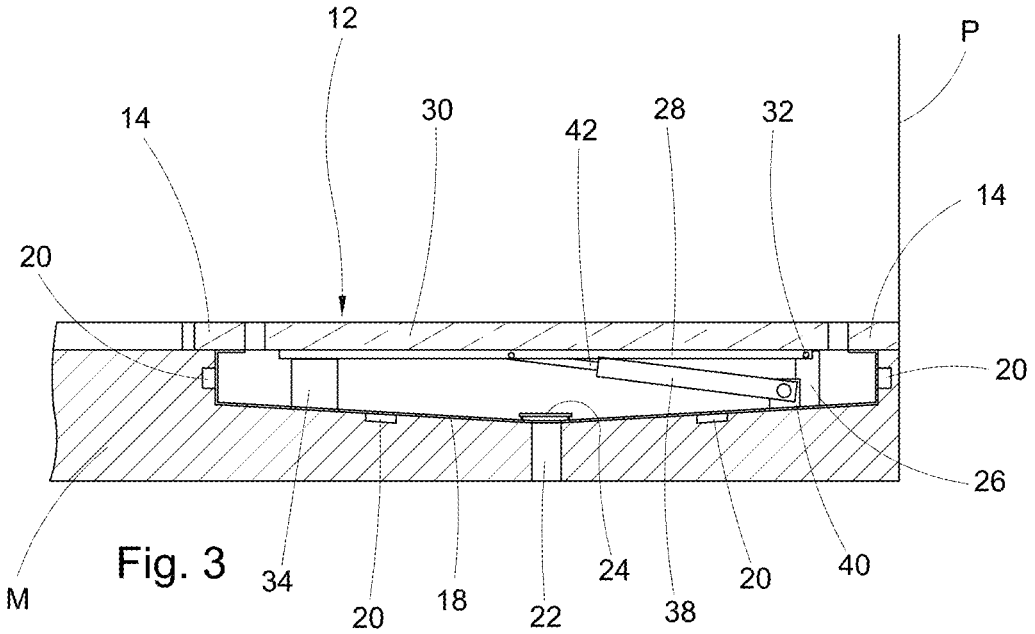
FIG. 3 is a schematic side view in section of the shower tray arranged according to the configuration in FIG. 1.
Figure 4:
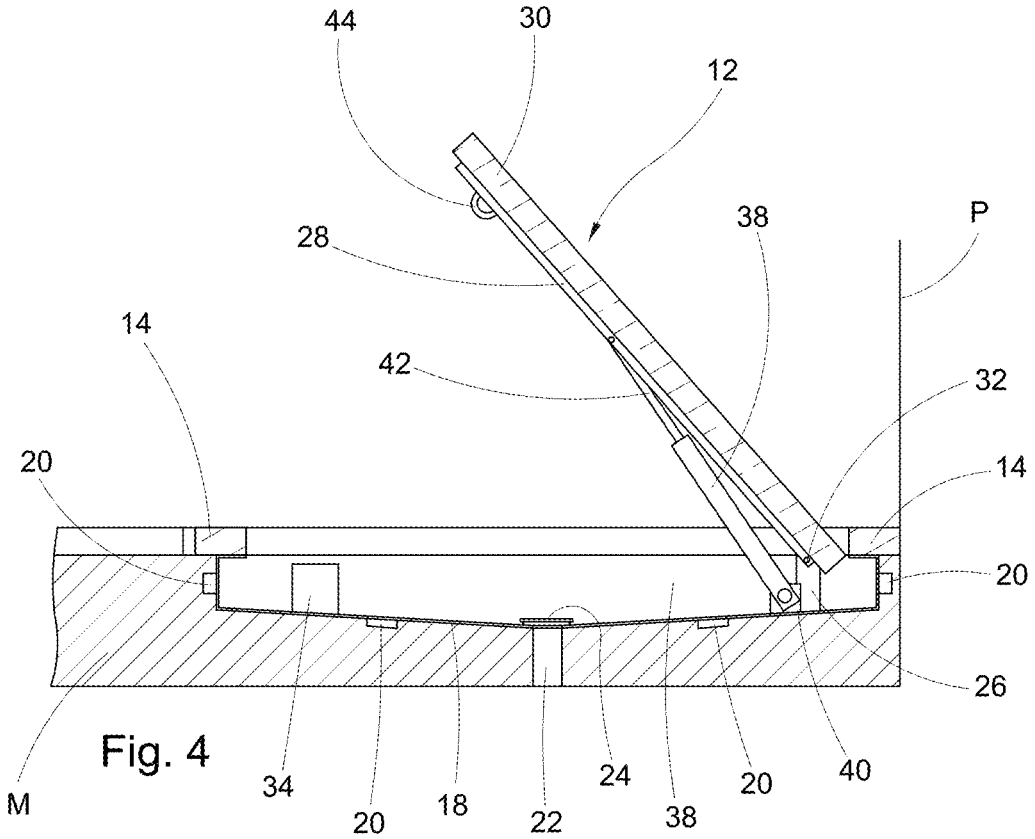
FIG. 4 is a schematic side view in section of the shower tray arranged according to the configuration in FIG. 2.

On a side of the collecting tub 18, in particular on one of the sides adjacent to a wall P, two first supports 26 (of which only one is visible in FIGS. 3 and 4) are arranged. The walking surface 12 is pivoted to said first supports so that the walking surface can be inclined with respect to the collecting tub 18.

In particular, the walking surface 12 includes a frame 28 and a slab 30 which is fixed above the frame 28. The slab 30 is made of marble or other material as subsequently specified.

The frame 28 is pivoted to the first supports 26 by means of a first pin 32.

A first bearing element 34 and a second bearing element 36 are placed on the collecting tub 18 on the opposite side with respect to the first supports 26.

When the walking surface 12 is in the position to use the shower, the walking surface is arranged horizontally and the frame 28 is resting on the first bearing element 34 and second bearing element 36.

A gas spring 38 is inferiorly hinged to a bracket 40 and has a stem 42 which is bound with its free end to the frame 28 in a substantially central position.

The gas spring 38 is loaded in such a way as to lift the walking surface 12 upwards.

The frame 28 includes an eyelet 44 that is positioned at the opposite end with respect to the first pin 32.

In particular, when the walking surface 12 is in the horizontal position, the eyelet 44 is received in a fixing seat 46 formed in the first bearing element 34.

In said fixing seat 46 there is a mobile locking pin (not visible in the figures) which can be inserted in the eyelet 44 so as to lock the walking surface 12 in the horizontal position The locking pin is connected through a mechanical system to a switch which is placed on a wall which is adjacent to the shower and is easily reachable.

In case a user, for example cleaning staff, needs to lift the walking surface 12 to clean the collecting tub 18 and free the filtering means 24, the user can act on the switch and cause the translation of the locking pin so as to free the eyelet 44 from the locking pin itself and let the gas spring 38 be free to extend.

Consequently, the gas spring 38 causes the inclination of the walking surface 12 as well as the lifting of the walking surface from the collecting tub 18.

The locking pin is screwed onto a connection shaft included in the mechanical system connected to the switch. In case the switch or the mechanical system connected to the switch does not work, the user can screw the locking pin on the connection shaft by using a wrench that runs through the slot so as to translate it and free, in any case, the eyelet 44.

A technician of the sector can provide modifications or variants which are to be considered as included in the scope of protection of the present invention.

For example, the lifting means can be other than a gas spring, as previously said.

In fact, to lift the walking surface, toothed wheels can also be used, alternatively or combined, or crank gear transmission systems, hydraulic pistons, electric actuators, pneumatic actuators, conventional thrust or compression springs, ropes or wires in nylon, steel or other material, chains in iron or other material.

Besides, the lifting system can be other than a rollover lifting system. In fact, the lifting system can be a rotating system, a vertical lifting system, a retractable system, or a pantograph system.

The walking surface can be also equipped with heating and/or cooling systems, vibrating systems for massage with rollers and other personal care systems.

The slab of the walking surface can be in material other than marble, for example in stone material or in any other solid material such as resin or other antiseptic or antibacterial material.

Besides, the walking surface of the slab can be treated to improve the aesthetic result and the mechanical yield, for example to avoid unwanted slips.

The shower provided with the shower tray according to the invention can include also other devices such as a touch screen control, an automatic washing device with sanitization, shower doors with automatic opening and closing, and adjustable lights.

Moreover, the shower tray according to the invention can have a shape other than square or rectangular, as described previously. The shower tray can be also circular or polygonal with a number of sides different from four, regular or irregular.

Furthermore, the collecting tub 18 can include one or more nozzles 61 from which, according to need, water with possible detergent substance can be supplied to wash and clean the collecting tub.

In this way, the washing of the collecting tub can be carried out automatically and comfortably.

The invention claimed is:

1. A shower tray (10), comprising:

a collecting tub (18) configured to be fixed on a screed (M);

a walking surface (12) placed at a top of the collecting tub (18), the walking surface (12) being surrounded by a coplanar perimeter frame (14), from which the walking surface is spaced so as to form a continuous perimeter slot (16) to allow water to flow into the collecting tub (18);

automatic lifting means (38) to lift the walking surface (12) with respect to the collecting tub (18); and a nozzle in the collecting tub (18) configured to spray water; into the collecting tub (18).

2. The shower tray (10) according to claim 1, wherein the walking surface (12) is pivoted along a first side to a first support (26) fixed to the collecting tub (18), so that the automatic lifting means (38) incline the walking surface (12).

3. The shower tray (10) according to claim 2, wherein locking means (34, 44, 46) are comprised and placed on an opposite side of the walking surface (12) with respect to the first side, the locking means configured to lock the walking surface (12) horizontally and coplanar to the perimeter frame (14).

4. The shower tray (10) according to claim 3, wherein the locking means include an eyelet (44) fixed to the walking surface (12) and a translating locking pin, arranged on the collecting tub (18) and adapted to be inserted into the eyelet (44) and removed from the eyelet (44) so as to lock and free the eyelet (44), respectively.

5. The shower tray (10) according to claim 4, wherein the locking pin is connected through a mechanical system to a switch.

6. The shower tray (10) according to claim 5, wherein the mechanical system includes a connection shaft to which the locking pin is screwed so as to translate the locking pin through a screwing thereof.

7. The shower tray according to claim 6, wherein the automatic lifting means include a gas spring with a movable stem, said gas spring being fixed to the collecting tub, a free end of the stem being fixed to the walking surface.

8. The shower tray according to claim 5, wherein the automatic lifting means include a gas spring with a movable stem, said gas spring being fixed to the collecting tub, a free end of the stem being fixed to the walking surface.

9. The shower tray according to claim 4, wherein the automatic lifting means include a gas spring with a movable stem, said gas spring being fixed to the collecting tub, a free end of the stem being fixed to the walking surface.

10. The shower tray according to claim 3, wherein the automatic lifting means include a gas spring with a movable stem, said gas spring being fixed to the collecting tub, a free end of the stem being fixed to the walking surface.

11. The shower tray according to claim 2, wherein the automatic lifting means include a gas spring with a movable stem, said gas spring being fixed to the collecting tub, a free end of the stem being fixed to the walking surface.

12. The shower tray according to claim 2, wherein the automatic lifting means include an actuator with a movable stem, said actuator being fixed to the collecting tub, a free end of the stem being fixed to the walking surface.

13. The shower tray (10) according to claim 1, wherein the automatic lifting means include a gas spring (38) with a movable stem (42), said gas spring (38) being fixed to the collecting tub (18), a free end of the stem (42) being fixed to the walking surface (12).

14. The shower tray (10) according to claim 1, wherein the automatic lifting means include an actuator with a movable stem, said actuator being fixed to the collecting tub, a free end of the stem being fixed to the walking surface (12).

15. The shower tray (10) according to claim 1, wherein the walking surface (12) includes a frame (28) and a slab (30) fixed at a top of the frame (28).

16. The shower tray (10) according to claim 15, wherein the slab (30) is in stone material.

17. A shower tray (10), comprising:

a collecting tub (18) configured to be fixed on a screed (M);

walking surface (12) placed at a top of the collecting tub (18), the walking surface (12) being surrounded by a coplanar perimeter frame (14) from which the walking surface is spaced so as to form a continuous perimeter slot (16) to allow water to flow into the collecting tub (18), and automatic lifting means (38) to lift the walking surface (12) with respect to the collecting tub (18), wherein the walking surface (12) is pivoted along a first side to a first support (26) fixed to the collecting tub (18), so that the automatic lifting means (38) incline the walking surface (12), and wherein locking means (34, 44, 46) are comprised and placed on an opposite side of the walking surface (12) with respect to the first side, the locking means configured to lock the walking surface (12) horizontally and coplanar to the perimeter frame (14).

18. The shower tray (10) according to claim 17, wherein the locking means include an eyelet (44) fixed to the walking surface (12) and a translating locking pin, arranged on the collecting tub (18) and adapted to be inserted into the eyelet (44) and removed from the eyelet (44) so as to lock and free the eyelet (44), respectively.

19. The shower tray (10) according to claim 18, wherein the locking pin is connected through a mechanical system to a switch.

20. The shower tray (10) according to claim 19, wherein the mechanical system includes a connection shaft to which the locking pin is screwed so as to translate the locking pin through a screwing thereof.

* * * * *